US010595144B2

(12) United States Patent
Cardinaux et al.

(10) Patent No.: US 10,595,144 B2
(45) Date of Patent: Mar. 17, 2020

(54) METHOD AND APPARATUS FOR GENERATING AUDIO CONTENT

(71) Applicant: Sony Corporation, Tokyo (JP)

(72) Inventors: Fabien Cardinaux, Stuttgart (DE); Michael Enenkl, Stuttgart (DE); Franck Giron, Waiblingen (DE); Thomas Kemp, Esslingen (DE); Stefan Uhlich, Renningen (DE)

(73) Assignee: SONY CORPORATION, Tokyo (JP)

( * ) Notice: Subject to any disclaimer, the term of this patent is extended or adjusted under 35 U.S.C. 154(b) by 383 days.

(21) Appl. No.: 15/127,716

(22) PCT Filed: Mar. 17, 2015

(86) PCT No.: PCT/EP2015/055557
§ 371 (c)(1),
(2) Date: Sep. 20, 2016

(87) PCT Pub. No.: WO2015/150066
PCT Pub. Date: Oct. 8, 2015

(65) Prior Publication Data

US 2018/0176706 A1 Jun. 21, 2018

(30) Foreign Application Priority Data

Mar. 31, 2014 (EP) ..... 14162675

(51) Int. Cl.
*H04S 7/00* (2006.01)
*G10L 21/0272* (2013.01)
*H04S 3/00* (2006.01)

(52) U.S. Cl.
CPC ..... *H04S 7/30* (2013.01); *G10L 21/0272* (2013.01); *H04S 3/008* (2013.01)

(58) Field of Classification Search
CPC ..... H04S 7/30; H04S 3/008; G10L 21/0272
USPC ..... 381/303
See application file for complete search history.

(56) References Cited

U.S. PATENT DOCUMENTS

2005/0036628 A1* 2/2005 Devito ..... G11B 27/034 381/61
2010/0111313 A1 5/2010 Namba et al.
2011/0058676 A1 3/2011 Visser
2011/0311060 A1* 12/2011 Kim ..... G10L 19/008 381/17

(Continued)

FOREIGN PATENT DOCUMENTS

JP 4943418 B2 5/2012
WO 2006/103581 A1 10/2006

OTHER PUBLICATIONS

Vincent, et al. "Blind audio source separation.", Nov. 24, 2005, Queen Mary, University of London, Tech Report C4DM-TR-05-01, pp. 1-26. (Year: 2005).*

(Continued)

*Primary Examiner* — Davetta W Goins
*Assistant Examiner* — Daniel R Sellers
(74) *Attorney, Agent, or Firm* — Xsensus, LLP

(57) ABSTRACT

In method the following is performed: receiving input audio content representing mixed audio sources; separating the mixed audio sources, thereby obtaining separated audio source signals and a residual signal; and generating output audio content by mixing the separated audio source signals and the residual signal.

18 Claims, 3 Drawing Sheets

(56) References Cited

U.S. PATENT DOCUMENTS

| | | | |
|---|---|---|---|
| 2014/0079248 | A1 | 3/2014 | Short et al. |
| 2014/0163991 | A1 | 6/2014 | Short et al. |
| 2014/0316771 | A1 | 10/2014 | Short et al. |

OTHER PUBLICATIONS

Stanislaw Gorlow, et al., "On the Informed Source Separation Approach for Interactive Remixing in Stereo", AES Convention 134, Total 10 Pages, (May 4-7, 2013), XP040575114.
International Search Report and Written Opinion dated May 22, 2015 in PCT/EP15/055557 Filed Mar. 17, 2015.
Chinese Notification of the First Office Action dated Mar. 1, 2019 in Chinese Application No. 2015800178153.

* cited by examiner

METHOD AND APPARATUS FOR GENERATING AUDIO CONTENT

TECHNICAL FIELD

The present disclosure generally pertains to a method and apparatus for generating audio content.

TECHNICAL BACKGROUND

There is a lot of legacy audio content available, for example, in the form of compact disks (CD), tapes, audio data files which can be downloaded from the internet, but also in the form of sound tracks of videos, e.g. stored on a digital video disk or the like, etc.

Typically, legacy audio content is already mixed from original audio source signals, e.g. for a mono or stereo setting, without keeping original audio source signals from the original audio sources which have been used for production of the audio content.

However, there exist situations or applications where a remixing or upmixing of the audio content would be desirable. For instance, in situations where the audio content shall be played on a device having more audio channels available than the audio content provides, e.g. mono audio content to be played on a stereo device, stereo audio content to be played on a surround sound device having six audio channels, etc. In other situations, the perceived spatial position of an audio source shall be amended or the perceived loudness of an audio source shall be amended.

Although there generally exist techniques for remixing audio content, it is generally desirable to improve methods and apparatus for remixing of audio content.

SUMMARY

According to a first aspect the disclosure provides a method, comprising: receiving input audio content representing mixed audio sources; separating the mixed audio sources, thereby obtaining separated audio source signals and a residual signal; and generating output audio content by mixing the separated audio source signals and the residual signal.

According to a second aspect the disclosure provides an apparatus, comprising: an audio input configured to receive input audio content representing mixed audio sources; a source separator configured to separate the mixed audio sources, thereby obtaining separated audio source signals and a residual signal; and an audio output generator configured to generate output audio content by mixing the separated audio source signals and the residual signal.

Further aspects are set forth in the dependent claims, the following description and the drawings.

BRIEF DESCRIPTION OF THE DRAWINGS

Embodiments are explained by way of example with respect to the accompanying drawings, in which.

DETAILED DESCRIPTION OF EMBODIMENTS

Figure 2:
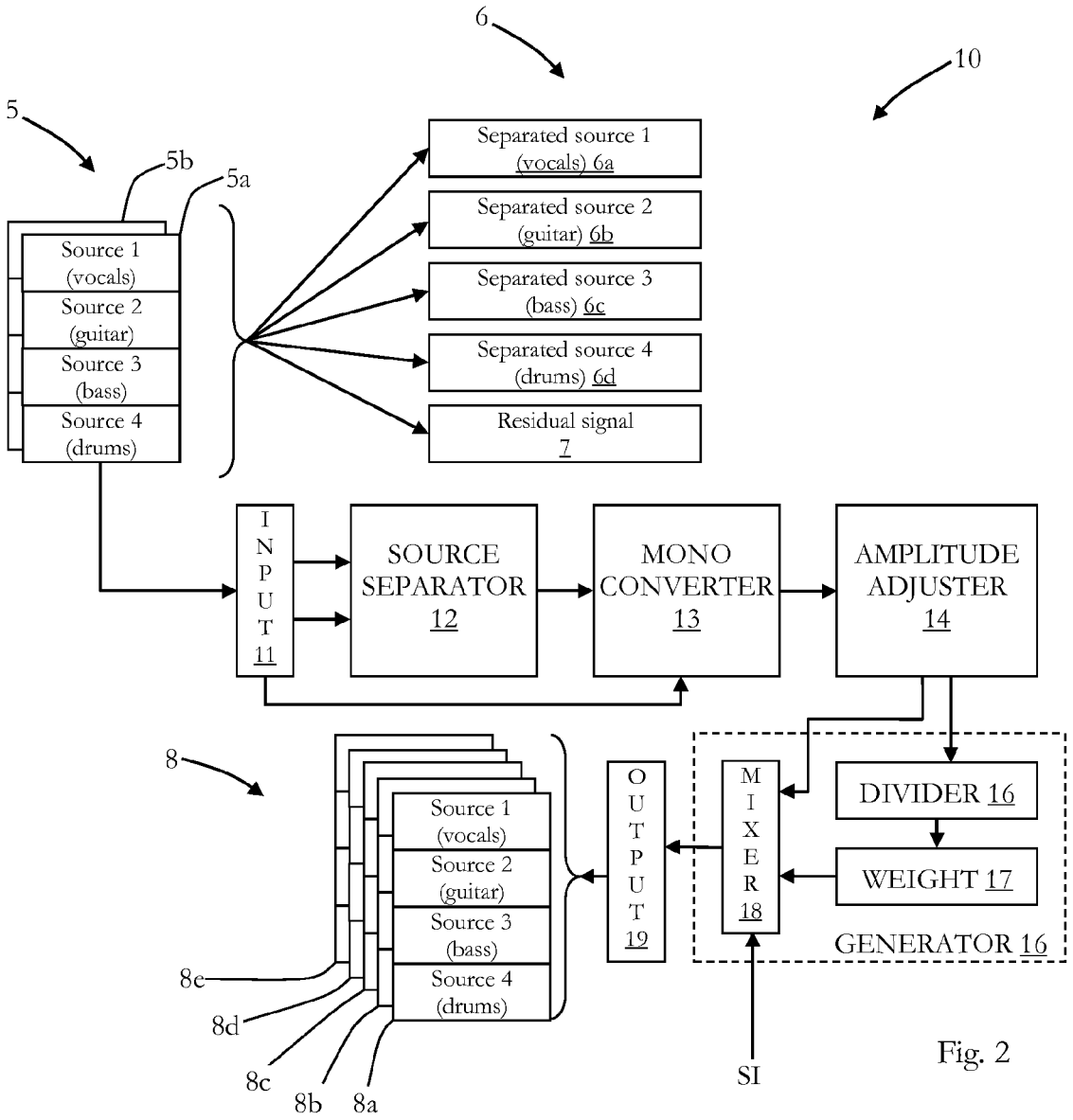
FIG. 2 schematically illustrates an apparatus for remixing of audio content.
Figure 3:
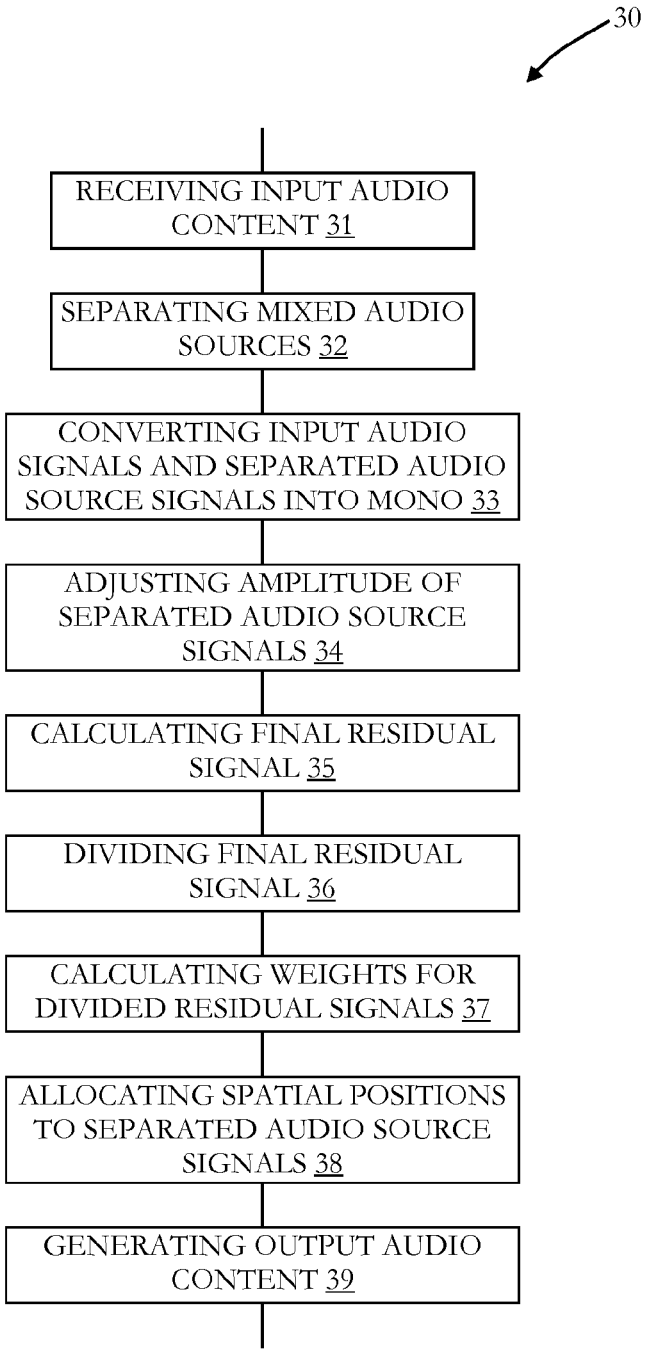
FIG. 3 is a flow chart for a method for remixing of audio content.

Before a detailed description of the embodiments under reference of FIGS. 2 and 3, general explanations are made.

As mentioned in the outset, there is a lot of legacy audio content available, for example, in the form of compact disks (CD), tapes, audio data files which can be downloaded from the internet, but also in the form of sound tracks of videos, e.g. stored on a digital video disk or the like, etc., which is already mixed, e.g. for a mono or stereo setting without keeping original audio source signals from the original audio sources which have been used for production of the audio content.

As discussed above, there exist situations or applications where a remixing or upmixing of the audio content would be desirable. For instance:

- Producing higher spatial surround sound than original audio content by a respective upmixing, e.g. mono->stereo, stereo->5.1 surround sound, etc.;
- Changing a perceived spatial position of an audio source by remixing (e.g. stereo->stereo);
- Changing a perceived loudness of an audio source by remixing (e.g. stereo->stereo);

or any combination thereof, etc.

At present, demixing of a mixed audio content is a difficult task, since the waves of different audio sources overlap and interfere with each other. Without having the original information of the sound waves for each audio source, it is nearly impossible to extract the original waves of mixed audio sources for each of the audio sources.

Generally, there exist techniques for the separation of sources, but, typically, the quality of audio content produced by (re)mixing audio sources separated with such techniques is poor.

In some embodiments a method for remixing, upmixing and/or downmixing of mixed audio sources in an audio content comprises receiving input audio content representing mixed audio sources; separating the mixed audio sources, thereby obtaining separated audio source signals and a residual signal; and generating output audio content by mixing the separated audio source signals and the residual signal, for example, on the basis of spatial information, on the basis of suppressing an audio source (e.g. a music instrument), and/or on the basis of increasing/decreasing the amplitude of an audio source (e.g. of a music instrument).

In the following, the terms remixing, upmixing, and downmixing can refer to the overall process of generating output audio content on the basis of separated audio source signals originating from mixed input audio content, while the term "mixing" can refer to the mixing of the separated audio source signals. Hence the "mixing" of the separated audio source signals can result in a "remixing", "upmixing" or "downmixing" of the mixed audio sources of the input audio content.

In the following, for illustration purposes, the method will also be explained under reference of FIG. 1.

The input audio content can include multiple (one, two or more) audio signals, wherein each audio signal corresponds to one channel. For instance, FIG. 1 shows a stereo input audio content 1 having a first channel input audio signal 1*a* and a second channel input audio signal 1*b*, without that the present disclosure is limited to input audio contents with two audio channels, but the input audio content can include any number of channels. The number of audio channels of the input audio content is also referred to as "$M_{in}$" in the following. Hence, the input audio content 1 has two channels, $M_{in}=2$ for the example of FIG. 1.

The input audio content can be of any type. It can be in the form of analog signals, digital signals, it can origin from a compact disk, digital video disk, or the like, it can be a data file, such as a wave file, mp3-file or the like, and the present disclosure is not limited to a specific format of the input audio content.

Figure 1:
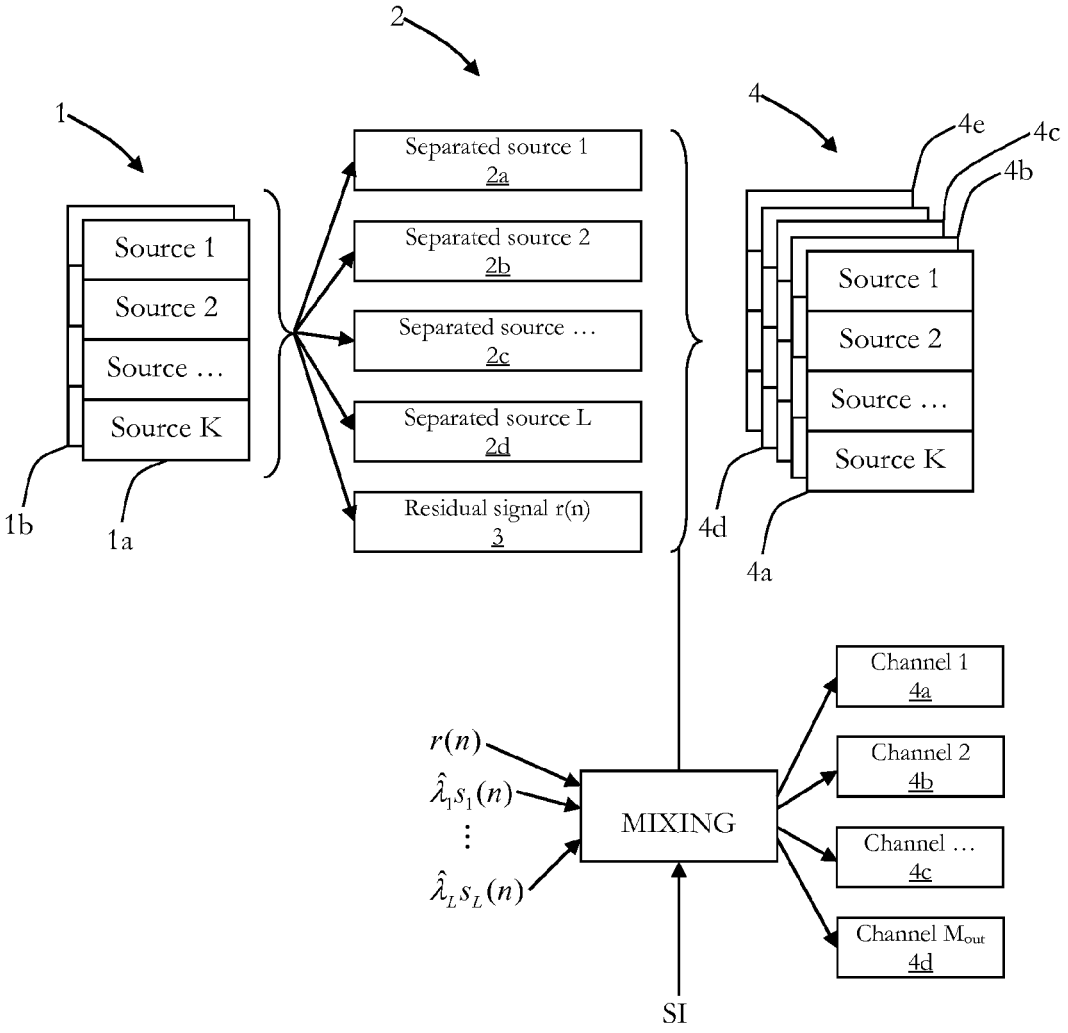
FIG. 1 generally illustrates a remixing of audio content.

The input audio content represents a number of mixed audio sources, as also illustrated in FIG. 1, where the input audio content 1 includes audio sources 1, 2, . . . , K, wherein K is an integer number and denotes the number of audio sources.

An audio source can be any entity which produces sound waves, for example, music instruments, voice, vocals, artificial generated sound, e.g. originating form a synthesizer, etc. The audio sources are represented by the input audio content, for example, by its respective recorded sound waves. For input audio content having more than one audio channel, such as stereo or surround sound input audio content, also a spatial information for the audio sources can be included or represented by the input audio content, e.g. by the different sound waves of each audio source included in the different audio signals representing a respective audio channel.

The input audio content represents or includes mixed audio sources, which means that the sound information is not separately available for all audio sources of the input audio content, but that the sound information for different audio sources e.g. at least partially overlaps or is mixed.

In the picture of FIG. 1 this means that the K audio sources are mixed and each of the audio signals 1*a* and 1*b* can include a mixture of K audio sources, i.e. a mixture of sound waves of each of the K audio sources.

The mixed audio sources (1, . . . , K in FIG. 1) are separated (also referred to as "demixed") into separated audio source signals, wherein, for example, a separate audio source signal for each audio source of the mixed audio sources is generated. As the separation of the audio source signals is imperfect, for example, due to the mixing of the audio sources and a lack of sound information for each audio source of the mixed audio sources, a residual signal is generated in addition to the separated audio source signals.

The term "signal" as used herein is not limited to any specific format and it can be an analog signal, a digital signal or a signal which is stored in a data file, or any other format.

The residual signal can represent a difference between the input audio content and the sum of all separated audio source signals.

This is also visualized in FIG. 1, where the K sources of the input audio content 1 are separated into a number of separated audio source signals 1, . . . , L, wherein the totality of separated audio source signals 1, . . . , L is denoted with reference sign 2 and the first separated audio source signal 1 is denoted with reference sign 2*a*, the second separated audio source signal 2 is denoted with reference sign 2*b*, and the Lth separated audio source signal L is denoted with reference sign 2*d* in the specific example of FIG. 1. As mentioned, the separation of the input audio content is imperfect, and, thus, in addition to the L separated audio source signals a residual signal r(n), which is denoted with the reference number 3 in FIG. 1, is generated.

The number K of sources and the number L of separated audio source signals can be different. This can be the case, for example, when only one audio source signal is extracted, while (all) the other sources are represented by the residual signal. Another example for a case where L is smaller than K is where an extracted audio source signal represents a group of sources. The group of sources can represent, for example, a group including the same type of music instruments (e.g. a group of violins). In such cases it might not be possible and/or not desirable to extract an audio source signal for an individual or for individuals of the group of audio sources, e.g. individual violins of the group of violins, but it might be enough to separate one audio source signal representing the group of sources. This could be useful for input audio content, where, for example, the group of sources, e.g. group if violins, is located at one spatial position.

The separation of the input audio content into separated audio source signals can be performed on the basis of the known blind source separation, also referred to as "BSS", or other techniques which are able to separate audio sources. Blind source separation allows the separation of (audio) source signals from mixed (audio) signals without the aid of information about the (audio) source signals or the mixing process. Although some embodiments use blind source separation for generating the separated audio source signals, the present disclosure is not limited to embodiments where no further information is used for the separation of the audio source signals, but in some embodiments further information is used for generation of separated audio source signals. Such further information can be, for example, information about the mixing process, information about the type of audio sources included in the input audio content, information about a spatial position of audio sources included in the input audio content, etc.

In (blind) source separation source signals are searched that are minimally correlated or maximally independent in a probabilistic or information-theoretic sense, or on the basis of a non-negative matrix factorization structural constraints on the audio source signals can be found. Known methods for performing (blind) source separation are based on, for example, principal components analysis, singular value decomposition, independent component analysis, non-negative matrix factorization, etc.

On the basis of the separated audio source signals and the residual signal, an output audio content is generated by mixing the separated audio source signals and the residual signal on the basis of at least one of spatial information, suppressing an audio source (e.g. a music instrument), and de/increasing the amplitude of an audio source (e.g. of a music instrument).

The output audio content is exemplary illustrated and denoted with reference number 4 in FIG. 1. The output audio content represents audio sources 1, 2, . . . , K which are based on the separated audio source signals and the residual signal. The output audio content can include multiple audio channel signals, as illustrated in FIG. 1, where the output audio content 4 includes five audio output channel signals 4*a* to 4*d*. The number of audio channels which are included in the output audio content is also referred to as "$M_{out}$" in the following, and, thus, in the exemplary case of FIG. 1 $M_{out}=5$.

In the example of the FIG. 1 the number of audio channels $M_{in}=2$ of the input audio content 1 is smaller than the number of audio channels $M_{out}=5$ of the output audio content 4, which is, thus, an upmixing from the stereo input audio content 1 to 5.1 surround sound output audio content 4.

Generally, a process of mixing the separated audio source signals where the number of audio channels $M_{in}$ of the input audio content is equal to the number of audio channels $M_{out}$ of the output audio content, i.e. $M_{in}=M_{out}$, can be referred to as "remixing", while a process where the number of audio channels $M_{in}$ of the input audio content is smaller the number of audio channels $M_{out}$ of the output audio content, i.e. $M_{in}<M_{out}$, can be referred to as "upmixing" and a process where the number of audio channels $M_{in}$ of the input audio content is larger than the number of audio channels $M_{out}$ of the output audio content, i.e. $M_{in}>M_{out}$, can be referred to as "downmixing". The present disclosure is not limited to a specific number of audio channels; all kinds of remixing, upmixing and downmixing can be realized.

As mentioned, the generation of the output audio content is based on spatial information (also referred to as "SI", FIGS. 1 and 2). The spatial information can include, for example, position information for the respective audio sources represented by the separated audio source signals. The position information can be referred to the position of a virtual user listening to the audio content. The position of such a virtual user is also referred to as "sweet spot" in the art. The spatial information can also be derived in some embodiments from the input audio content. For instance, panning information included in the input audio content can be used as spatial information. Furthermore, in some embodiments, a user can select position information via an interface, e.g. a graphical user interface. The user can then, e.g. place an audio source at a specific location (e.g. a violin in a front left position, etc.).

For instance, a first audio source can be located in front of such a sweet spot, a second audio source can be located on a left corner, a third audio source on a right corner, etc., as it is generally known to the skilled person. Hence, in some embodiments, the generation of the output audio content includes allocating a spatial position to each of the separated audio source signals, such that the respective audio source is perceived at the allocated spatial position when listening to the output audio content in the sweet spot.

For generating the output audio content on the basis of the spatial information any known spatial rendering method can be implemented, e.g. vector base amplitude panning ("VBAP"), wave field synthesis, ambisonics, etc.

As also indicated above, in some embodiments, the input audio content includes a number of input audio signals (e.g. audio signals 1*a* and 1*b* with $M_{in}=2$, FIG. 1), each input audio signal representing one audio channel. The generation of the output audio content can include the mixing of the separated audio source signals (e.g. separated audio source signals 2*a* to 2*d*, FIG. 1) such that the output audio content includes a number of output audio signals each representing one audio channel (such as output audio signals 4*a* to 4*d*, FIG. 1), wherein the number of output audio signals $M_{out}$ is equal to or larger than the number of input audio signals $M_{in}$. The number of output audio signals $M_{out}$ can also be lower than the number of input audio signals $M_{in}$.

In some embodiments, an amplitude of each of the separated audio source signals is adjusted, thereby minimizing the energy or amplitude of the residual signal, as will also be explained in more detail below.

In some embodiments, the generation of the output audio content includes allocating a spatial position to the residual signal, such that the output audio content includes the mixed residual signal being at a predefined spatial position with respect, for example, to the sweet spot. The spatial position can be, for example, the center of a virtual room or any other position. In some embodiments, the residual signal can also be treated as a further separated audio source signal.

In some embodiments, the generation of the output audio content includes dividing the residual signal into a number of divided residual signals on the basis of the number of separated audio source signals and adding a divided residual signal respectively to a separated audio source signal. Thereby, the residual signal can be equally distributed to the separated audio sources signals.

For example, in the case of a number of L separated source signals, the weight can be calculated as $$\frac{1}{\sqrt{L}},$$

such that a number of L divided residual signals $r_1(n)$, $r_2(n), \ldots, r_L(n)$ are obtained each having a weighting factor of $$\frac{1}{\sqrt{L}}.$$

Thus, the divided residual signals have the same weight in this embodiment.

As the residual signal is distributed to all separated audio source signals, a time delay for the residual signal will not perceptible in the case of playing the output audio content with loudspeakers having different distances to the sweet spot. In such embodiments, the residual signal is shared by all separated audio source signals in a time invariant manner.

In some embodiments, each of the divided residual signals has a variable weight, which is, for example, time dependent. In some embodiments, each of the divided residual signals has one variable weight, wherein the weights for different divided residual signals differ from each other.

Each of the variable weights can depend on at least one of: current content of the associated separated audio source signal, previous content of the associated separated audio signal and future content of the associated separated audio signal.

Each variable weight is associated with a respective separated audio source signal to which a respective divided residual signal is to be added. The separated audio source signal can be divided, for example, in time frames or any other time dependent pieces. Hence, a current content of a separated audio source signal can be the content of a current time frame of the separated audio source signal, a previous content of a separated audio source signal can be the content of one or more previous time frames of the separated audio source signal (the time frames do not need to be consecutive to each other), and a future content of a separated audio source signal can be the content of one or more future time frames being after the current frame of the separated audio source signal (the time frames do not need to be consecutive to each other).

In embodiments, where the variable weight depends on future content of the associated separated audio signal, the generation of the output audio content can be made in a non real time manner and, for example, the separated audio source signals are stored in a memory for processing.

Moreover, the variable weight can also depend in an analog manner on at least one of current content of the residual signal, previous content of the residual signal and future content of the residual signal.

The variable weights and/or the weighted divided residual signals can be low-pass filtered to avoid perceivable distortions due to the time-variant weights.

In some embodiments, it is, thus, possible to add more of the residual signal to a respective separated audio source signals where it most likely belongs to.

For example, the variable weight can be proportional to the energy (e.g. amplitude) of the associated separated audio source signal. Hence, the energy (or amplitude) correspondingly varies with the energy (e.g. amplitude) of the associated separated audio source signal, i.e. the "stronger" the associated separated audio source signal is the larger is the associated variable weight. In other words, the residual signal basically belongs to separated audio source signals with the highest energy.

The variable weight can also depend on the correlation between the residual signal and an associated separated audio source signal. For instance, the variable weight can depend on the correlation between the residual signal of a current time frame the associated separated audio source signal of a previous time frame or of a future time frame. The variable weight can be proportional to an average correlation value or to a maximum correlation value obtained by correlation between the residual signal of a current time frame the associated separated audio source signal of a previous time frame or of a future time frame. In the case that the correlation with a future time frame of the associated separated audio source signal is calculated, the calculation can be performed in a non real-time manner, e.g. on the basis of stored residual and audio source signals.

In other embodiments, the calculation of the (variable) weight can also be performed in real time.

Under reference of FIG. 1, the method(s) described above are now explained for a specific mathematical approach, without limiting the present disclosure to that specific approach.

As mentioned, an input audio content (1, FIG. 1) can be separated or demixed into a number of "L" separated audio sources $\vec{s}_l(n) \in \Re^{M\times 1}$, also referred to as "separations" hereinafter, from the original input audio content $\vec{x}(n) \in \Re^{Min\times 1}$, where "M" denotes the number of audio channels of the separations $s_l(n)$ and n denotes the discrete time. Typically, the number M of audio channels of the separations $s_l(n)$ will be equal to the number $M_{in}$ of audio channels of the input audio content x(n). The separations $s_l(n)$ and the input audio content x(n) are a vector when the number of audio channels is greater than one.

As discussed, the separation of the input audio content 1 into L separated audio source signals 2*a* to 2*d* can be done with any suitable source separation method and it can be done with any kind of separation criterion.

For the sake of clarity and simplicity, without limiting the present disclosure in that regard, in the following it is assumed that the separation is done by music instruments as audio sources (wherein vocals are considered as a music instrument), such that $s_1(n)$, for example, could be a guitar, $s_2(n)$ could be a keyboard, etc.

At next, the input audio content as well as the separated audio source signals can be converted by any known technique to a single channel format, i.e. mono, if required, i.e. in the case that $M_{in}$ and/or M is greater than one. In some embodiments, generally, the input audio content and the separated audio source signals are converted into a mono format for the further processing.

Hence, the vectors "Separated audio sources" $s_l(n)$ and "Input audio content" x(n) are converted into scalars:

$$\vec{s}_l(n) \rightarrow s_l(n), \vec{x}(n) \rightarrow x(n)$$

Thereby, for example, the L separated audio source signals 2*a* to 2*d* as illustrated in FIG. 1 are obtained.

At next, as also mentioned above, the average amplitude of each of the separated audio source signals $s_l(n)$ (now in mono format) is adjusted in order to minimize the energy of the residual signal. This is done, in some embodiments, by solving the following least squares problem:

$$\{\hat{\lambda}_1, \ldots, \hat{\lambda}_L\} = \arg\min_{\lambda_1,\ldots,\lambda_L} \sum_{n=1}^{N} (x(n) - \lambda_1 s_1(n) - \ldots - \lambda_L s_L(n))^2$$

In order to cancel time delays between different separations $s_l(n)$, time shifts $\hat{n}_l$ can be estimated in some embodiments such that $$\sum_{n=1}^{N} (x(n) - \lambda_1 s_1(n - n_1) - \ldots - \lambda_L s_L(n - n_L))^2$$

is minimized.

Thereby, the residual signal r(n) can be calculated by subtracting from the mono-type input audio signal x(n) all L separated audio source signals $s_l(n)$ (l=1, . . . , L), wherein each of the separated audio source signal is weighted with its associated adjusted average amplitude $\hat{\lambda}_l$:

$$r(n) = x(n) - \hat{\lambda}_1 s_1(n - \hat{n}_1) - \ldots - \hat{\lambda}_L s_L(n - \hat{n}_L)$$

The residual signal r(n) can then be incorporated (mixed) into the output audio content, e.g. by adding it to the amplitude adjusted separated audio source signals $\hat{\lambda}_1 s_1(n), \ldots, \hat{\lambda}_L s_L(n)$ or any other method, as described above.

This is also illustrated in FIG. 1, where the residual signal r(n) and the amplitude adjusted separated audio source signals $\hat{\lambda}_1 s_1(n), \ldots, \hat{\lambda}_L s_L(n)$ are mixed on the basis of spatial information "SI" with a known spatial rendering method in order to generate output audio content 4 including a number of $M_{out}$ audio signals 4*a* to 4*d* for each audio channel, wherein each audio signal 4*a* to 4*d* of the output audio content 4 includes the separated audio source signals 2*a* to 2*d* mixed as described above. Thus, the output audio content 4 represents the K audio sources of the input audio content 1.

In some embodiments, an apparatus comprises one or more processors which are configured to perform the method(s) described herein, in particular, as described above.

In some embodiments, an apparatus which is configured to perform the method(s) described herein, in particular, as described above, comprises an audio input configured to receive input audio content representing mixed audio sources, a source separator configured to separate the mixed audio sources, thereby obtaining separated audio source signals and a residual signal, and an audio output generator configured to generate output audio content by mixing the separated audio source signals and the residual signal on the basis of spatial information.

In some embodiments, as also described above, the input audio content includes a number of input audio signals, each input audio signal representing one audio channel, and wherein the audio output generator is further configured to mix the separated audio source signals such that the output audio content includes a number of output audio signals each representing one audio channel, wherein the number of output audio signals is equal to or larger than the number of input audio signals.

The apparatus can further comprise an amplitude adjuster configured to adjust the separated audio source signals, thereby minimizing an amplitude of the residual signal, as described above.

In some embodiments, the audio output generator is further configured to allocate a spatial position to each of the separated audio source signals and/or to the residual signal, as described above.

The audio output generator can further be configured to divide the residual signal into a number of divided residual signals on the basis of the number of separated audio source signals and to add a divided residual signal respectively to a separated audio source signal, as described above.

In some embodiments, as described above, the divided residual signals have the same weight and/or they have a variable weight.

As describe above, the variable weight and/or the residual signal can depend on at least one of: current content of the associated separated audio signal, previous content of the associated separated audio signal and future content of the associated separated audio signal, and the variable weight can be proportional to the energy of the associated separated audio source signal and/or to a correlation between the residual signal and the associated separated audio source signal.

The apparatus can be a surround sound system, an audio player, an audio-video receiver, a television, a computer, a portable device (smartphone, laptop, etc.), a gaming console, or the like.

The output audio content can be in any format, i.e. analog/digital signal, data file, etc., and it can include any type of audio channel format, such as mono, stereo, 3.1, 5.1, 6.1, 7.1, 7.2 surround sound or the like.

By using the residual signal, in some embodiments, the output audio content contains less artefacts than without the residual signal and/or at least less artefacts are perceived by a listener, even in cases where the separation into separated audio source signals results in a degradation of sound quality.

Moreover, in some embodiments, no further information about the mixtures process and/or the sources of the input audio content is needed.

Returning to FIG. 2, there is illustrated an apparatus 10 in the form of a 5.1 surround sound system, referred to as "sound system 10" hereinafter.

The sound system 10 has an input 11 for receiving an input audio signal 5. In the present example, the input audio signal is in the stereo format and it has a left channel input audio signal 5*a* and a right channel input audio signal 5*b*, each including exemplary four sources 1 to 4, which are for pure illustration purposes a vocals source 1, a guitar source 2, a bass source 3, and a drums source 4.

The input 11 is implemented as a stereo cinch plug input and it receives, for example, the input audio content 5 from a compact disk player (not shown).

The two input audio signals 5*a* and 5*b* of the input audio content 5 are fed into a source separator 12 of the sound system 10, which performs a source separation as discussed above.

The source separator 12 generates as output four separated audio source signals 6 for each of the four sources of the input audio content, namely a first separated audio source signal 6*a* for the vocals, a second separated audio source signal 6*b* for the guitar, a third separated audio source signal 6*c* for the bass and a fourth audio separated source signal 6*d* for the drums.

The two input audio source signals 5*a* and 5*b* as well as the separated audio source signals 6 are fed into a mono converter 13 of the sound system 10, which converts the two input audio source signals 5*a* and 5*b* as well as the separated audio source signals 6 into a single channel (mono) format, as described above.

For feeding the two input audio source signals 5*a* and 5*b* to the mono converter 13, the input 11 is coupled to the mono converter, without that the present disclosure is limited in that regard. For example, the two input audio source signals 5*a* and 5*b* can also be fed through the source separator 12 to the mono converter 13.

The mono type separated audio source signals are fed into an amplitude adjuster 14 of the sound system 10, which adjusts and averages the amplitudes of the separated audio source signals, as described above. Additionally, the amplitude adjuster 14 cancels any time shifts between the separated audio source signals, as described above.

The amplitude adjuster 14 also calculates the residual signal 7 be subtracting from the monotype input audio signal all amplitude adjusted separated audio source signals, as described above.

The thereby obtained residual signal 7 is fed into a divider 16 of an output audio content generator 16 and the amplitude adjusted separated audio source signals are fed into a mixer 18 of the output audio content generator 16.

The divider 16 divides the residual signal 7 into a number of divided residual signals corresponding to the number of separated source signals, which is four in the present case.

The divided residual signals are fed into a weight unit 17 of the output audio content generator 16 which calculates a weight for the divided residual signals and adds the weight to the divided residual signals.

In the present embodiment, the weight unit 17 calculates the weight in accordance with the formula described above, namely $1/\sqrt{L}$, which results in ½ for the present case, as L=4. Of course, in other embodiments, the weight unit 17 and the output audio content generator 16, respectively, can be adapted to perform any other of the methods for calculating the weights, such as the variable weights discussed above.

The thereby weighted divided residual signals are also fed into the mixer 18, which mixes the amplitude adjusted separated audio source signals and the weighted divided residual signals on the basis of spatial information SI and on the basis on a known spatial rendering method, as described above.

The spatial information SI includes a spatial position for each of the four separated audio source signals representing the four sources vocals, guitar, bass and drums. As discussed, in other embodiments, the spatial information SI can also include a spatial position for the residual signal, for example, in cases where the residual signal is treated as a further source, as discussed above.

Thereby, the output audio content generator 16 generates an output audio content 8 which is output via an output 19 of the sound systems 10.

The output audio content 8 is in the 5.1 surround sound format and it has five audio channel signals 8*a* to 8*d* each including the mixed sources vocals, guitars, bass and drums, which can be fed form output 19 to respective loudspeakers (not shown).

Please note that the division of the sound system 10 into units 11 to 19 is only made for illustration purposes and that the present disclosure is not limited to any specific division of functions in specific units. For instance, the sound system 10 could be implemented at least partially by a respective programmed processor(s), field programmable gate array(s) (FPGA) and the like.

A method 30 for generating output audio content, which can be, for example, performed by the sound system 10 discussed above, is described in the following and under reference of FIG. 3. The method can also be implemented as a computer program causing a computer and/or a processor to perform the method, when being carried out on the computer and/or processor. In some embodiments, also a non-transitory computer-readable recording medium is provided that stores therein a computer program product, which, when executed by a processor, such as the processor described above, causes the method described to be performed.

At 31, an input audio content including input audio signals is received, such as input audio content 1 or 5 as described above.

The mixed audio sources included in the input audio content are separated into separated audio source signals at 32, as described above.

At 33, the input audio signals and the separated audio source signals are converted into a single channel format, i.e. into mono, as described above.

At 34, the amplitude of the separated audio source signals is adjusted and the final residual signal is calculated at 35 by subtracting the sum of amplitude adjusted separated audio source signals from the monotype input audio signal, as described above.

At 36, the final residual signal is divided into divided residual signals on the basis of the number of separated audio source signals and weights for the divided residual signals are calculated at 37, as described above.

At 38, spatial positions are allocated to the separated audio source signals, as described above.

At 39, output audio content, such as output audio content 4 or 8 (FIGS. 1 and 2, respectively), is generated on the basis of the weighted divided residual signals, the amplitude adjusted separated audio source signals and the spatial information.

The methods as described herein are also implemented in some embodiments as a computer program causing a computer and/or a processor to perform the method, when being carried out on the computer and/or processor. In some embodiments, also a non-transitory computer-readable recording medium is provided that stores therein a computer program product, which, when executed by a processor, such as the processor described above, causes the methods described herein to be performed.

All units and entities described in this specification and claimed in the appended claims can, if not stated otherwise, be implemented as integrated circuit logic, for example on a chip, and functionality provided by such units and entities can, if not stated otherwise, be implemented by software.

In so far as the embodiments of the disclosure described above are implemented, at least in part, using software-controlled data processing apparatus, it will be appreciated that a computer program providing such software control and a transmission, storage or other medium by which such a computer program is provided are envisaged as aspects of the present disclosure.

Note that the present technology can also be configured as described below.

(1) A method, comprising:

receiving input audio content representing mixed audio sources;

separating the mixed audio sources, thereby obtaining separated audio source signals and a residual signal; and generating output audio content by mixing the separated audio source signals and the residual signal.

(2) The method of (1), wherein the generation of the output audio content is performed on the basis of spatial information.

(3) The method of (1) or (2), wherein the input audio content includes a number of input audio signals, each input audio signal representing one audio channel, and wherein the generation of the output audio content includes the mixing of the separated audio source signals such that the output audio content includes a number of output audio signals each representing one audio channel, wherein the number of output audio signals is equal to or larger than the number of input audio signals.

(4) The method of anyone of (1) to (3), further comprising adjusting an amplitude of the separated audio source signals, thereby minimizing an amplitude of the residual signal.

(5) The method of anyone of (1) to (4), wherein the generation of the output audio content includes allocating a spatial position to each of the separated audio source signals.

(6) The method of anyone of (1) to (5), wherein the generation of the output audio content includes allocating a spatial position to the residual signal.

(7) The method of anyone of (1) to (6), wherein the generation of the output audio content includes dividing the residual signal into a number of divided residual signals on the basis of the number of separated audio source signals and adding a divided residual signal respectively to a separated audio source signal.

(8) The method of (7), wherein the divided residual signals have the same weight.

(9) The method of (7), wherein the divided residual signals have a variable weight.

(10) The method of (9), wherein the variable weight depends on at least one of: current content of the associated separated audio source signal, previous content of the associated separated audio source signal and future content of the associated separated audio source signal.

(11) The method of (9) or (10), wherein the variable weight is proportional to the energy of the associated separated audio source signal.

(12) An apparatus, comprising:

an audio input configured to receive input audio content representing mixed audio sources;

a source separator configured to separate the mixed audio sources, thereby obtaining separated audio source signals and a residual signal; and an audio output generator configured to generate output audio content by mixing the separated audio source signals and the residual signal.

(13) The apparatus of (12), wherein the audio output generator is configured to generate output audio content by mixing the separated audio source signals and the residual signal on the basis of spatial information.

(14) The apparatus of (12) or (13), wherein the input audio content includes a number of input audio signals, each input audio signal representing one audio channel, and wherein the audio output generator is further configured to mix the separated audio source signals such that the output audio content includes a number of output audio signals each representing one audio channel, wherein the number of output audio signals is equal to or larger than the number of input audio signals.

(15) The apparatus of anyone of (12) to (14), further comprising an amplitude adjuster configured to adjust the separated audio source signals, thereby minimizing an amplitude of the residual signal.

(16) The apparatus of anyone of (12) to (15), wherein the audio output generator is further configured to allocate a spatial position to each of the separated audio source signals.

(17) The apparatus of anyone of (12) to (16), wherein the audio output generator is further configured to allocate a spatial position to the residual signal.

(18) The apparatus of anyone of (12) to (17), wherein the audio output generator is further configured to divide the residual signal into a number of divided residual signals on the basis of the number of separated audio source signals and to add a divided residual signal respectively to a separated audio source signal.

(19) The apparatus of (18), wherein the divided residual signals have the same weight.

(20) The apparatus of (18), wherein the divided residual signals have a variable weight.

(21) The apparatus of (20), wherein the variable weight depends on at least one of: current content of the associated separated audio source signal, previous content of the associated separated audio source signal and future content of the associated separated audio source signal.

(22) The apparatus of (20) or (21), wherein the variable weight is proportional to the energy of the associated separated audio source signal.

(23) A computer program comprising program code causing a computer to perform the method according to anyone of (1) to (11), when being carried out on a computer.

(24) A non-transitory computer-readable recording medium that stores therein a computer program product, which, when executed by a processor, causes the method according to anyone of (1) to (11) to be performed.

(25) An apparatus, comprising at least one processor configured to perform the method according to anyone of (1) to (11).

The invention claimed is:

1. A method, comprising:

receiving input audio content representing mixed audio sources;

separating the mixed audio sources, thereby obtaining separated audio source signals and a residual signal, the residual signal being a signal which remains after the mixed audio sources have been separated, the residual signal resulting from an imperfect separation of the mixed audio sources; and generating output audio content by mixing the separated audio source signals and the residual signal.

2. The method of claim 1, wherein the generation of the output audio content is performed on the basis of spatial information.

3. The method of claim 1, wherein the input audio content includes a number of input audio signals, each input audio signal representing one audio channel, and wherein the generation of the output audio content includes the mixing of the separated audio source signals such that the output audio content includes a number of output audio signals each representing one audio channel, wherein the number of output audio signals is equal to or larger than the number of input audio signals.

4. The method of claim 1, further comprising adjusting an amplitude of the separated audio source signals, thereby minimizing an amplitude of the residual signal.

5. The method of claim 1, wherein the generation of the output audio content includes allocating a spatial position to each of the separated audio source signals.

6. The method of claim 1, wherein the generation of the output audio content includes allocating a spatial position to the residual signal.

7. The method of claim 1, wherein the generation of the output audio content includes dividing the residual signal into a number of divided residual signals on the basis of the number of separated audio source signals and adding a divided residual signal respectively to a separated audio source signal.

8. The method of claim 7, wherein the divided residual signals have the same weight.

9. The method of claim 7, wherein the divided residual signals have a variable weight.

10. The method of claim 9, wherein the variable weight depends on at least one of: current content of the associated separated audio source signal, previous content of the associated separated audio source signal and future content of the associated separated audio source signal.

11. The method of claim 9, wherein the variable weight is proportional to the energy of the associated separated audio source signal.

12. An apparatus, comprising:

an audio input configured to receive input audio content representing mixed audio sources;

a source separator configured to separate the mixed audio sources, thereby obtaining separated audio source signals and a residual signal, the residual signal being a signal which remains after the mixed audio sources have been separated, the residual signal resulting from an imperfect separation of the mixed audio sources; and an audio output generator configured to generate output audio content by mixing the separated audio source signals and the residual signal.

13. The apparatus of claim 12, wherein the audio output generator is configured to generate output audio content by mixing the separated audio source signals and the residual signal on the basis of spatial information.

14. The apparatus of claim 12, wherein the input audio content includes a number of input audio signals, each input audio signal representing one audio channel, and wherein the audio output generator is further configured to mix the separated audio source signals such that the output audio content includes a number of output audio signals each representing one audio channel, wherein the number of output audio signals is equal to or larger than the number of input audio signals.

15. The apparatus of claim 12, further comprising an amplitude adjuster configured to adjust the separated audio source signals, thereby minimizing an amplitude of the residual signal.

16. The apparatus of claim 12, wherein the audio output generator is further configured to allocate a spatial position to each of the separated audio source signals.

17. The apparatus of claim 12, wherein the audio output generator is further configured to allocate a spatial position to the residual signal.

18. The apparatus of claim 12, wherein the audio output generator is further configured to divide the residual signal into a number of divided residual signals on the basis of the number of separated audio source signals and to add a divided residual signal respectively to a separated audio source signal.

* * * * *